United States Patent [19]

Kawamura et al.

[11] 4,242,992

[45] Jan. 6, 1981

[54] INTERNAL COMBUSTION ENGINE WITH FUEL INJECTORS

[75] Inventors: Yoshihisa Kawamura, Fujisawa; Masaaki Saito, Yokosuka, both of Japan

[73] Assignee: Nissan Motor Company, Limited, Yokohama, Japan

[21] Appl. No.: 949,060

[22] Filed: Oct. 6, 1978

[30] Foreign Application Priority Data

Oct. 7, 1977 [JP] Japan ..... 52-120016

[51] Int. Cl.[3] ..... F02B 3/00

[52] U.S. Cl. ..... 123/491; 123/179 L

[58] Field of Search ..... 123/32 EH, 32 EL, 32 EA, 123/32 ED, 32 EG, 179 L

[56] References Cited

U.S. PATENT DOCUMENTS

| | | | |
|---|---|---|---|
| 3,614,945 | 10/1971 | Schlagmüller et al. | 123/32 EG |
| 3,812,830 | 5/1974 | Traisnel | 123/32 EG |
| 3,884,195 | 5/1975 | Murtin et al. | 123/32 EA |
| 3,935,851 | 2/1976 | Wright et al. | 123/32 EA |
| 3,946,704 | 3/1976 | Monpetit | 123/32 EA |
| 4,002,152 | 1/1977 | Hoshi | 123/32 EA |
| 4,140,088 | 2/1979 | de Vulpillieres | 123/32 EA |

FOREIGN PATENT DOCUMENTS

| | | | |
|---|---|---|---|
| 2535918 | 3/1977 | Fed. Rep. of Germany | 123/32 EG |

*Primary Examiner*—P. S. Lall

*Attorney, Agent, or Firm*—Schwartz, Jeffery, Schwaab, Mack, Blumenthal & Koch

[57] ABSTRACT

Main and auxiliary fuel injectors are installed at an intake passageway connectable to the cylinders of the engine. Only the main fuel injector is operated to inject fuel therefrom during a relatively low load engine operation, and both the main and auxiliary fuel injectors are operated to inject fuel therefrom during a relatively high load engine operation.

6 Claims, 4 Drawing Figures

INTERNAL COMBUSTION ENGINE WITH FUEL INJECTORS

BACKGROUND OF THE INVENTION

This invention relates to an internal combustion engine equipped with fuel injectors for supplying fuel into the cylinders of the engine, and more particularly to an internal combustion engine equipped with main and auxiliary fuel injectors in order to supply the cylinders of the engine with suitable amounts of fuel.

It is well known in art, that only one fuel injector is installed at the intake passageway of the engine to supply the cylinders of the engine with fuel injected from the fuel injector. This fuel injector is, in general, composed of an electromechanical valve which is arranged to open to inject fuel during the time period corresponding to the pulse-width determined in accordance with various engine operating parameters. Accordingly, the amount of fuel supplied to the cylinders is in proportion to the pulse-width.

In such a fuel injector, the opening area of the electromechanical valve is set to meet the maximum fuel supply amount required, for example, during the maximum power output engine operation in which the above-mentioned pulse-width is the maximum or the electromechanical valve is continuously maintained at the fully open condition.

Hence, the above-mentioned pulse-width for controlling the fuel injector must be small during a relatively low power output engine operation in which a relatively small amount of intake air is required, particularly during idling of the engine. The accuracy of the electromechanical valve of the injector depends on the actuation lag time due to the friction of the mechanical parts of the valve. The actuation lag time is, for example, about 1.6 ms from the closed condition to the open condition, and about 0.9 ms from the open condition to the closed condition.

Therefore, the extreme fluctuation of the opening time of the electromechanical valve is encountered during the low power output engine operation in which the opening time or the pulse-width for controlling the valve is shorter than about 2 to 2.5 ms. This shows that it is difficult to maintain a high accuracy in fuel supply amount regulation during such the low engine power output engine operation. This difficulty increases with increase in the number of the cylinders of the engine and with increase in the total volume of the engine cylinders.

SUMMARY OF THE INVENTION

It is the prime object of the present invention to provide an improved internal combustion engine equipped with fuel injectors, by which a high accuracy in fuel supply amount regulation is achieved even during a low power output engine operation in which a relatively small amount of intake air is required, satisfying the maximum fuel supply amount required during the maximum power output engine operation.

Another object of the present invention is to provide an improved internal combustion engine equipped with main and auxiliary fuel injectors which are installed at the intake passageway of the engine, only the main fuel injector being operable to obtain a high accuracy in fuel supply amount regulation during a relatively low load engine operation, whereas both the main and auxiliary fuel injectors being operable to obtain a large amount of fuel supply during a relatively high load engine operation.

A further object of the present invention is to provide an improved internal combustion engine which is equipped with main and auxiliary fuel injectors installed at the intake passageway of the engine, in which only the main fuel injector is operated to inject fuel while an engine operating parameter still represents a relatively low power output engine operation, whereas both the main and auxiliary fuel injectors are operated to inject fuel while the engine operating parameter represents a relatively high output engine operation.

In this regard, the main fuel injector is operated so as to inject fuel into the intake passageway in a variable amount according to the engine operating condition, and the auxiliary fuel injector is operated so as to inject fuel into the intake passageway in a constant amount irrespective of the engine operating condition.

Other objects, features and advantages of the engine according to the present invention will be more apparent from the following description taken in conjunction with the accompanying drawings.

DESCRIPTION OF THE PREFERRED EMBODIMENT

Figure 1:
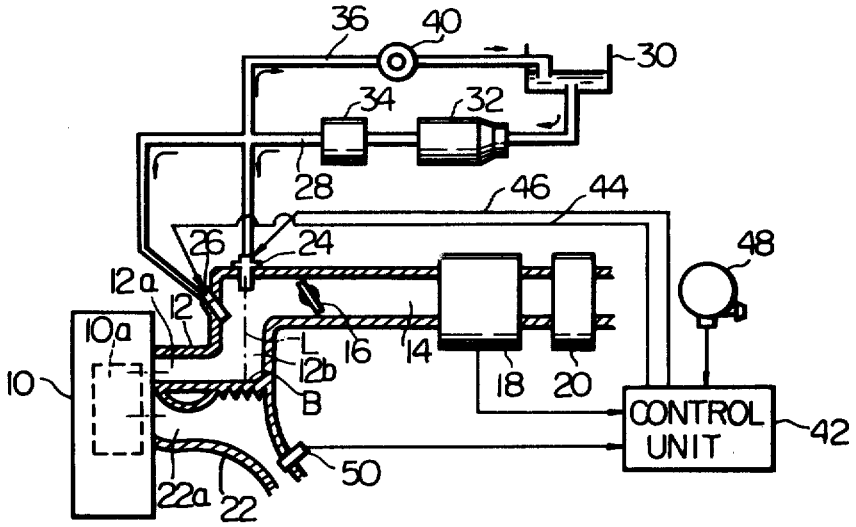
FIG. 1 is a schematic illustration of a preferred embodiment of an internal combustion engine in accordance with the present invention.

Referring now to FIG. 1 of the drawings, a preferred embodiment of an internal combustion engine of a motor vehicle, according to the present invention is shown including an engine body 10 or engine block which is formed with a plurality of cylinders 10*a* (only one cylinder shown). Each cylinder is connectable to branch runners 12*a* (only one runner shown) of an intake manifold 12 which forms part of an intake passageway 14. A throttle valve 16 is rotatably disposed in the intake passageway 14 to control the amount of intake air supplied to the cylinders. A known air flow meter 18 is disposed upstream of the throttle valve 16 to measure the amount of intake air passing through the intake passageway 14. Disposed upstream of the air flow meter 18 is an air filter 20 for removing dusts contained in air inducted through the intake passageway 14. Each cylinder is, as usual, also connectable to branch runners (only one runner shown) 22*a* of an exhaust manifold 22 through which exhaust gases from the cylinders are discharged out of the engine.

A main fuel injector 24 is disposed in a manifold riser 12*b* or a riser portion connected to the intake manifold 12. The riser 12*b* is formed with its bottom portion B which is constructed to be contactable with the exhaust gases from the cylinders to receive heat of the exhaust gases in order to promote vaporization of fuel supplied to the manifold riser 12*b*. In this case, the bottom portion B contacts the exhaust manifold 22. In other words, the wall forming the bottom portion B is shared by the intake and exhaust manifolds 12 and 22. Therefore, the bottom portion B serves as a heat exchanger.

The main fuel injector 24 is located opposite to the bottom portion B to inject fuel toward the bottom portion B. In this instance, the main fuel injector 24 is located so that its longitudinal axis (not shown) substantially lies on the longitudinal axis L of the manifold riser 12*b*. In addition to the main fuel injector 24, an auxiliary fuel injector 26 is disposed in the manifold riser 12*b* to inject fuel thereinto.

The main and auxiliary fuel injectors 24 and 26 are connected through a fuel feed pipe 28 to a fuel tank 30. The reference numeral 32 designates a fuel pump which pressurizes the fuel from the fuel tank 30 to supply the pressurized fuel to the fuel injectors 24 and 26 through a fuel filter 34 for removing impurities contained in the fuel.

A fuel return pipe 36 is branched off from a portion of the fuel feed pipe 28 between the fuel filter 34 and the fuel injectors 24 and 26 to be connected between the fuel feed pipe 28 and the fuel tank 30. The return line 36 is provided with a pressure regulator 40 which functions to regulate the fuel pressure in the fuel feed pipe 28 by venting the fuel therethrough to the fuel tank 30 when the fuel pressure in the fuel feed pipe 28 exceeds a certain high level.

The main and auxiliary fuel injectors 24 and 26 are electrically connected to a control unit 42 through conductors 44 and 46, respectively. The main fuel injector 24 is composed of an electromechanical valve (not shown) which is arranged to open during a time duration corresponding to the pulse-width of a main injector operating signal supplied from the control unit 42 and therefore the fuel injector injects fuel during opening of the electromechanical valve. The auxiliary fuel injector 26 is also composed of an electromechanical valve (not shown) which is arranged to open when required in accordance with an auxiliary injector operating signal from the control unit 42. In other words, the electromechanical valve of the auxiliary fuel injector 26 is of a so-called "ON-OFF" type wherein the valve is put into either of an "ON" position for continuously open the valve and an "OFF" position for continuously close the valve. Accordingly, fuel is continuously injected in a constant injection amount through the valve when the valve is put into the "ON" position.

The control unit 42 is electrically connected to the air flow meter 18 to sense the air flow amount of intake air inducted through the intake passageway 14 to the engine cylinders, and to a distributor 48 to sense engine speed, for example, by detecting ignition noises generated at the contact breaker of the distributor 48. The control unit 42 is arranged to produce the above-mentioned main and auxiliary injector operating signals in accordance with at least one of the amount of intake air and the engine speed. The control unit 42 is further electrically connected to an oxygen sensor 50 for sensing the concentration of oxygen gas $O_2$ contained in the exhaust gases from the exhaust manifold 22. Accordingly, the oxygen sensor 50 is disposed to contact with the exhaust gases in the exhaust passage (no numeral) downstream of the manifold 22.

While the known air flow meter 18 has been shown and described to measure the air flow amount of intake air, it will be understood that the air flow amount may be measured by sensing the opening degree of the throttle valve 16 and sensing the intake manifold vacuum downstream of the throttle valve 16.

The operational characteristics of the main and auxiliary fuel injectors 24 and 26 of the engine according to the present invention will be explained with reference to the graph of FIG. 2.

In the engine of the present invention, the maximum amount qMm(max) of fuel injection or supply of the main fuel injector 24 and the maximum amount qMs(max) of fuel injection or supply of the auxiliary fuel injector 26 are selected to meet the maximum fuel amount qMt required for the combustion in the engine body 10. The maximum amounts of fuel injections of the fuel injectors 24, 26 and the maximum fuel amount required for the combustion in the engine body 10 are in the following relationship to leave a margin in the amount of fuel to be supplied to the engine body 10:

$$qMm(\max)+qMs(\max)=qMt$$

Figure 2:
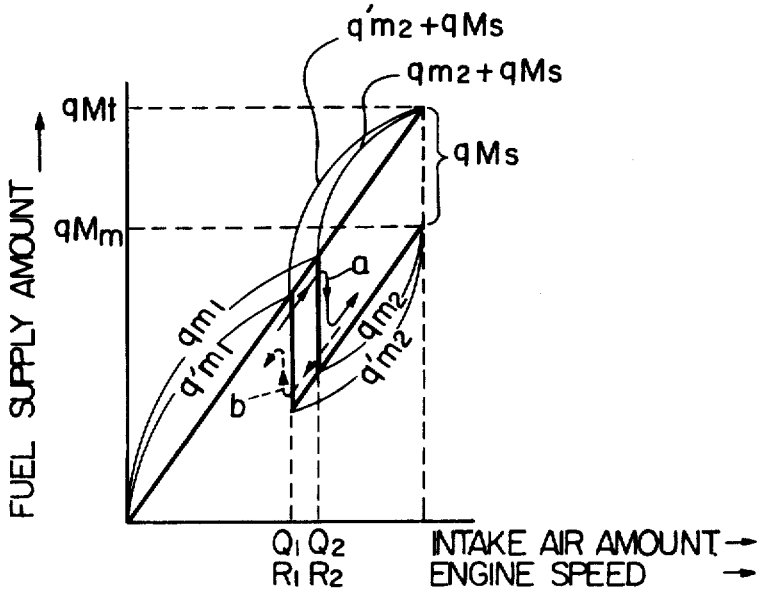
FIG. 2 is a graph showing the operational characteristics of main and auxiliary fuel injectors used in the engine of FIG. 1.

As shown in the graph of FIG. 2, the amount of fuel injection of the main fuel injector 24 increases as indicated by a line $qm_1$, as the amount of intake air increases and reaches a second predetermined value $Q_2$, for example, of 200 $m^3$/hour, exceeding a first predetermined value $Q_1$. Of course, the second predetermined value $Q_2$ is larger in amount than the first predetermined value $Q_1$. When the intake air amount reaches the second predetermined value $Q_2$, the fuel injection amount of the main fuel injector 24 is changed to a lower value in the direction of a solid arrow a and increases as indicated by a line $qm_2$ as the intake air amount increases. Simultaneously, the auxiliary fuel injector 26 begins to operate to inject fuel in a constant amount qMs which is the required maximum amount of fuel injection or supply of the auxiliary fuel injector 24. This fuel injection amount qMs is set as follows:

$$qMs=qMt-qm_2 \text{ (the maximum value)}$$

Accordingly, when the intake air amount exceeds the second predetermined value $Q_2$, the fuel supply up to the maximum required amount is accomplished by the cooperation of the main and auxiliary fuel injectors 24 and 26.

As seen from the graph of FIG. 2, since the fuel supply amount range of the main fuel injector 24 is considerably low as compared with the maximum fuel amount qMt required for the engine, it will be understood that the fuel injection can be carried out sufficiently accurately during a low fuel amount engine operating condition in which a relatively small amount of intake air is required and accordingly a relatively small amount of injected fuel is required. For example, when the maximum required fuel amount qMt is about 40 lit./hour, the required maximum amount qMm of fuel injection or supply of the main fuel injector 24 is set preferably at about 25 lit./hour and the constant fuel injection amount qMs of the auxiliary fuel injector 26 is set preferably at about 15 lit./hour.

Conversely, while the intake air amount decreases from under an engine operating condition requiring relatively large amounts of intake air and fuel, the main fuel injector 24 continues to inject fuel in the amount indicated by a line $qm_2$ and the auxiliary fuel injector 26 continues to inject in the constant amount qMs. When the intake air amount reaches and decreases below the first predetermined value $Q_1$, the fuel injection amount of the main fuel injector 24 is increased along the direction of a dotted arrow b and then decreases as indicated by a line $q'm_2$. Simultaneously, the fuel injection of the auxiliary fuel injector 26 is stopped. Thus, both the main and auxiliary fuel injectors 24 and 26 are operated to inject fuel until the intake air amount decreases to the first predetermined value $Q_1$, whereas only the main fuel injector 24 is operated to inject fuel after the intake air decreases beyond the first predetermined value $Q_1$. Therefore, it will be appreciated that the accuracy in fuel supply to the engine can be improved under the low fuel amount engine operating condition.

It is to be noted that the first and second predetermined values $Q_1$ and $Q_2$ in intake air amount are set different to obtain stable fuel supply to the engine. In other words, such different first and second predetermined values can prevent a so-called "hunting" or unnecessary frequency changing from operations of the main and auxiliary fuel injectors 24 and 26 to only operation of the main fuel injector 24 and vice versa when the engine is operated near a point at which the above-mentioned changing is carried out.

While the auxiliary fuel injector 26 has been shown and described to be of the type wherein the fuel injection amount is set at a constant value qMs, it will be understood the injector 26 may be of the type wherein the fuel injection amount is variable in accordance with the pulse-width of an electric signal supplied thereto which pulse-width corresponds to intake air inducted into the engine proper 10 through the intake passageway 14.

Futhermore, although the fuel injectors 24 and 26 have been described to be controlled in accordance with intake air amounts, it may be possible to control them 24 and 26 in accordance with other engine operating parameters in close relation to the intake air amount, for example, engine speed. In case where the engine speed is used as a control parameter for the fuel injectors 24 and 26, changing in fuel injection manner is carried out at engine speeds $R_1$ (for example, 4000 rpm) and $R_2$ (for example, 4500 rmp) which correspond to first and second predetermined values $Q_1$ and $Q_2$ of intake air amounts, respectively.

It will be understood that a main fuel injector 24 may be installed per one cylinder and the auxiliary fuel injector 26 may be installed at a portion of the intake manifold 12 from which portion the branch runners are branched off. In this case, the maximum fuel injection amount can be smaller than in the case of FIG. 1 and therefore the area of the fuel injection opening of the main fuel injector 24 can be selected to be considerably small and the pulse-width for operating the injector 24 can be considerably increased, to improve the precision in controlling the main fuel injector 24.

Figure 3:
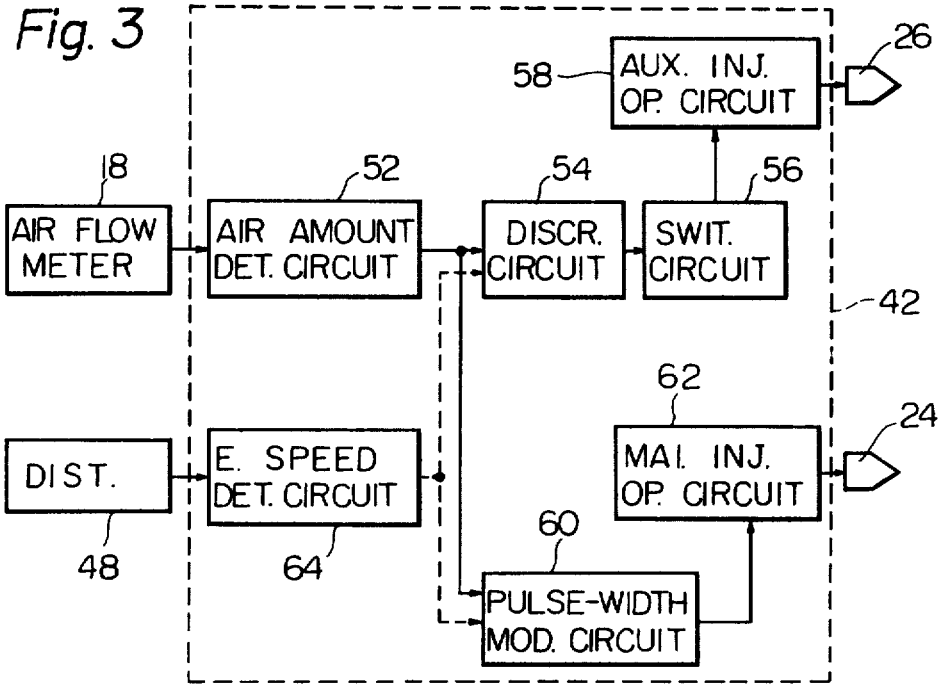
FIG. 3 is a circuit diagram showing a control unit used in the engine of FIG. 1.

FIG. 3 illustrates in detail the circuits of the above-mentioned control unit 42 for controlling the operations of the main and auxiliary fuel injectors 24 and 26. The control unit 42 is composed of an intake air amount detecting circuit 52 which is electrically connected to the air flow meter 18 to be fed with an electric signal from the flow meter 18. A discriminating circuit 54 is electrically connected to the intake air amount detecting circuit 52 to be supplied to an electric signal from the circuit 52. A switching circuit 56 is electrically connected to the circuit 54 so as to be operated in accordance with an electric signal from the circuit 54. An auxiliary fuel injector operating circuit 58 is electrically connected to the circuit 56 so as to open or close the electromechanical valve of the auxiliary fuel injector 26 to inject fuel or stop the fuel injection to the intake passageway 14. Consequently, the circuit 58 is electrically connected to the auxiliary fuel injector 26.

As shown, the intake air amount detecting circuit 52 is further electrically connected to a pulse-width modulating circuit 60. The fuel amount injected from the main fuel injector 24 changes in accordance with the pulse-width, since the electromechanical valve of the fuel injector 24 opens to inject fuel during the time duration corresponding to the above-mentioned pulse-width. The pulse-width modulating circuit 60 is further electrically connected to the switching circuit 56 to be fed with the output signal from the circuit 56. The circuit 60 is electrically connected through a main fuel injector operating circuit 62 to the main fuel injector 24. Accordingly, the main fuel injector 24 is arranged to inject fuel in accordance with the pulse-width modulated in the circuit 60 upon receiving the output signal from the switching circuit 56. It will be appreciated from the foregoing, that the cylinders of the engine body 10 are supplied with required amounts of fuel in accordance with engine operating conditions.

The operation of the control unit 42 will be explained in detail hereinafter.

The discriminating circuit 54 discriminates that the intake air amount Q supplied to the cylinders of the engine body 10 is in either condition of $Q<Q_1$, $Q_1 \leqq Q<Q_2$, and $Q_2 \leqq Q$. The switching circuit 56 is put from "OFF" position to "ON" position for the first time when the intake air amount is in the condition of $Q_2 \leqq Q$ upon increase of the intake air amount Q. If the circuit 56 is once put into the "ON" position, the "ON" position is maintained as long as the intake air amount decreases and is put into the condition of $Q<Q_1$. The circuit 56 is arranged to be changed from "ON" position into the "OFF" position for the first time when the intake air amount reaches to the condition of $Q<Q_1$.

The electromechanical valve of the auxiliary fuel injector 26 is arranged to open to inject fuel through the operating circuit 58 only when the switching circuit 54 is put into the "ON" position. Simultaneously, the pulse-width modulating circuit 60 modulates the pulse-width to control the opening time duration of the electromechanical valve of the main fuel injector 24 in accordance with the intake air amount. It is to be noted that the pulse-width modulating circuit 60 is arranged to be controlled also in accordance with the positions of the switching circuit 56. In this regard, when the switching circuit 56 is in the "OFF" position, the pulse-width is modulated so that the fuel injection amount is varied along the line $qm_1$ or $q'm_1$ in the graph of FIG. 2, whereas when the switching circuit 56 is in the "ON" position, the pulse-width is modulated so that the fuel injection amount is varied along line $qm_2$ or $q'm_2$.

By such a control manner for the main and auxiliary fuel injectors 24 and 26, the fuel supply amount q from the main fuel injector 24 and the auxiliary fuel injector 24 is as follows:

when $Q<Q_1$: fuel supply amount $q=qm_1$ or $q'm_1$
when $Q_2 \leqq Q$: $q=qm_2+qMs$ or $q'm_2+qMs$
when $Q_1 \leqq Q<Q_2$:
at "OFF" position of circuit 56; $q=qm_1$
at "ON" position of circuit 56; $q=q'm_2+qMs$ As appreciated from the above, a suitable amount of fuel can be supplied to the cylinders of the engine proper 10 only from the main fuel injector 24 or also from the auxiliary fuel injector 26.

While the main and auxiliary fuel injectors 24 and 26 have been described to be controlled in accordance with intake air amount which is detected by the air flow meter 18, they may be controlled in accordance with engine speed detected at the distributor 48. In the case using the engine speed as an operating parameter of the fuel injectors 24 and 26, the air flow meter 18 and the intake air amount detecting circuit 52 in FIG. 3 may be replaced with the distributor 48 and an engine speed detecting circuit 64 which are electrically connected to each other. Accordingly, the engine speed detecting circuit 64 is electrically connected to the discriminating circuit 54 and the pulse-width modulating circuit 60 as indicated by dotted arrows in FIG. 3.

Figure 4:
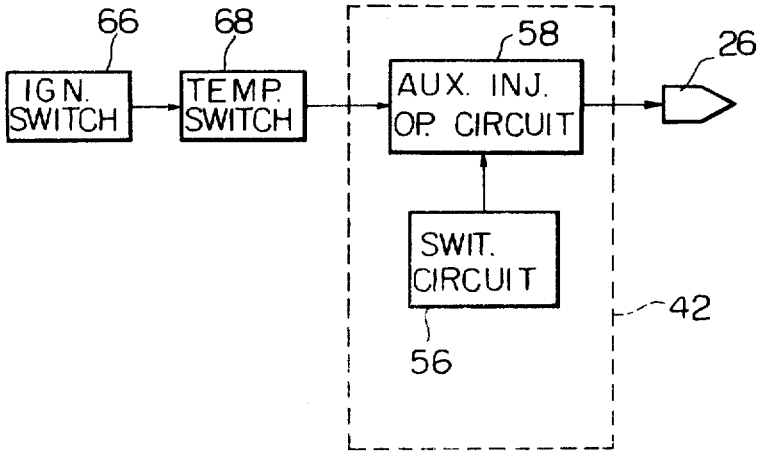
FIG. 4 is a circuit diagram showing means for starting cold engine, which is preferably installed in the engine of FIG. 1.

It is to be noted that the auxiliary fuel injector 26 may be used as means for easily starting cold engine. For this case, as shown in FIG. 4, an ignition switch 66 is electrically connected to an engine coolant temperature switch 68 which is arranged to be put into its "ON" position when the engine coolant temperature is below a predetermined level such as about 18° C., but put into its "OFF" position when the engine coolant temperature exceeds the predetermined level. The engine coolant temperature switch 68 is electrically connected to the auxiliary fuel injector operating circuit 58 so that the output signal from the temperature switch 68 is fed to the circuit 58, in a parallel relation with the output signal from the switching circuit 56.

With this arrangement of FIG. 4, when the ignition switch 66 is in its "engine starting" position and the temperature switch 68 is in the "ON" position, the auxiliary fuel injector 26 is operated to inject fuel although the switching circuit 24 is in the "OFF" position. However, the auxiliary fuel injector 26 can not be operated when the ignition switch 66 is changed from the "engine starting" position into its "ON" position at which the ignition system of the engine is supplied with electric current, but an engine starting motor (not shown) is not operated. Hence, the auxiliary fuel injector 26 is operated in response to the output signal from the switching circuit 56 after the engine is started by the engine starting motor. It will be seen from the above, that in this case, the auxiliary fuel injector operating circuit 58 includes means (not shown) for operating the auxiliary fuel injector 26 when the ignition switch is in the "engine starting" position and the engine coolant temperature switch is in the "ON" position.

The main fuel injector 24 has been shown and described to be located to inject fuel in the direction of the longitudinal axis L of the manifold riser 12*b* toward the bottom portion B of the manifold riser 12*b*. With this location of the main fuel injector 24, fuel from the main fuel injector 24 is injected to the central portion of the stream of the intake air to be effectively vapourized and carried by the intake air stream. This improves the distribution of the fuel injected into a plurality of the cylinders of the engine body 10.

However, it will be appreciated the above-mentioned location of the main fuel injector 24 is not necessarily required for the present invention. Because, the vapourization and the distribution of the injected fuel may be improved, for example, by providing ultrasonic vibration to fuel to be injected from the fuel injector 24.

What is claimed is:

1. An internal combustion engine having cylinders and an intake passageway through which air is supplied to the cylinders, comprising:

a main fuel injector;

means for operating said main fuel injector so as to inject fuel into the intake passageway in a variable amount according to the engine operating condition;

an auxiliary fuel injector;

means for operating said auxiliary fuel injector so as to inject fuel into the intake passageway in a constant amount when activated irrespective of the engine operating condition;

sensing means for sensing an engine operating parameter substantially representing the amount of intake air and for producing a signal in response to said parameter;

control means, responsive to said signal, said control means including said means for operating said main fuel injector and said means for operating said auxiliary fuel injector, said control means also including additional means for operating both said main and auxiliary fuel injectors until the magnitude of said parameter decreases to reach a first predetermined value below which value said auxiliary fuel injector is stopped and for operating only said main fuel injector until the magnitude of said parameter increases to reach a second predetermined value in excess of which value both said main fuel injector and said auxiliary fuel injector operate, the amount of intake air at the first predetermined value being smaller than that at the second predetermined value; and means for starting a cold engine, which cold engine starting means includes an ignition switch having an "engine starting" position at which an engine starting motor of the engine is operated to rotate and an engine coolant temperature switch which is operatively connected between said ignition switch and said auxiliary fuel injector operating means, said temperature switch being put into its "ON" position when the engine coolant temperature is below a predetermined level, said auxiliary fuel injector operating means including means for operating said auxiliary fuel injector when said ignition switch is in its "engine starting" position and said engine coolant temperature switch is in the "ON" position.

2. An internal combustion engine as claimed in claim 1, in which said sensing means includes an air flow meter for sensing the amount of intake air passing through the intake passageway and producing an electric signal in response to the intake air amount.

3. An internal combustion engine as claim in claim 2, in which said control means includes:

intake air amount detecting means for detecting the intake air amount in accordance with the electric signal from said air flow meter;

discriminating means for discriminating the condition of intake air amount in accordance with the intake air amount detected by said intake air amount detecting means;

switching means for being actuated when the intake air amount is at a particular condition discriminated by said discriminating means;

said auxiliary fuel injector operating means being coupled with said switching means for operating said auxiliary fuel injector to inject fuel when said switching means is actuated;

pulse-width modulating means for modulating the pulse-width for controlling said main fuel injector, in accordance with the intake air amount detected by said intake air amount detecting means and the actuation of the switching means; and said main fuel injector operating means being coupled with said pulse-width modulating means for operating said main fuel injector in accordance with the pulse-width modulated by said pulse-width modulating means.

4. An internal combustion engine as claimed in claim 1, in which said sensing means includes engine speed sensing means for sensing the engine speed and producing an electrical signal in response to the engine speed.

5. An internal combustion engine as claimed in claim 4, in which said control means includes:

engine speed detecting means for detecting the engine speed in accordance with the electric signal from a distributor;

discriminating means for discriminating the condition of engine speed in accordance with the engine speed detected by said engine speed detecting means;

switching means for being actuated when the engine speed is at a particular condition discriminated by said discriminating means;

said auxiliary fuel injector operating means being coupled with said switching means for operating said auxiliary fuel injector to inject fuel when said switching means is actuated;

pulse-width modulating means for modulating the pulse-width for controlling said main fuel injector, in accordance with the engine speed detected by said engine speed detecting means and the actuation of said switching means; and said main fuel injector operating means being coupled with said pulse-width modulating means for operating said main fuel injector in accordance with the pulse-width modulated by said pulse-width modulating means.

6. An internal combustion engine as claimed in claim 3 or 5, in which said auxiliary fuel injector is of an "ON-OFF" type wherein fuel is continuously injected at a constant amount during the time when the injector is put in its "ON" position.

* * * * *